US007690808B2

(12) United States Patent
Yoon

(10) Patent No.: US 7,690,808 B2
(45) Date of Patent: Apr. 6, 2010

(54) PREFABRICATED LIGHT REFLECTING SYSTEM MOUNTED TO CEILING OF ELEVATOR CAGE

(76) Inventor: Il Shik Yoon, 476-35 Gurobondong, Gurogu, Seoul (KR) 152-059

( * ) Notice: Subject to any disclaimer, the term of this patent is extended or adjusted under 35 U.S.C. 154(b) by 497 days.

(21) Appl. No.: 11/587,831

(22) PCT Filed: Jun. 7, 2005

(86) PCT No.: PCT/KR2005/001685

§ 371 (c)(1),
(2), (4) Date: Jul. 19, 2007

(87) PCT Pub. No.: WO2005/121011

PCT Pub. Date: Dec. 22, 2005

(65) Prior Publication Data

US 2008/0130294 A1 Jun. 5, 2008

(30) Foreign Application Priority Data

Jun. 8, 2004 (KR) ..... 10-2004-0041737
Jan. 13, 2005 (KR) ..... 20-2005-0001031 U

(51) Int. Cl.
*F21S 8/04* (2006.01)

(52) U.S. Cl. ..... 362/147; 362/217.05; 362/249.01; 362/297; 362/301

(58) Field of Classification Search ..... 362/147, 362/148, 145, 217.05, 235, 249.01, 297, 362/298, 301, 303, 346, 347
See application file for complete search history.

(56) References Cited

U.S. PATENT DOCUMENTS 4,425,603 A * 1/1984 Courson ..... 362/222
4,704,662 A * 11/1987 Makino ..... 362/147

* cited by examiner

*Primary Examiner*—Sharon E Payne
(74) *Attorney, Agent, or Firm*—Lumen Patent Firm

(57) ABSTRACT

Disclosed herein is a prefabricated light reflecting system having standardized reflectors to be mounted to corners of the ceiling of an elevator cage. Here, a required number of reflectors are successively connectable to correspond to the size of the elevator cage. The light reflecting system includes a corner reflector, a bulb mounting plate, and an end reflector. If necessary, one or more intermediate reflectors may be added.

11 Claims, 4 Drawing Sheets

[Fig. 1]
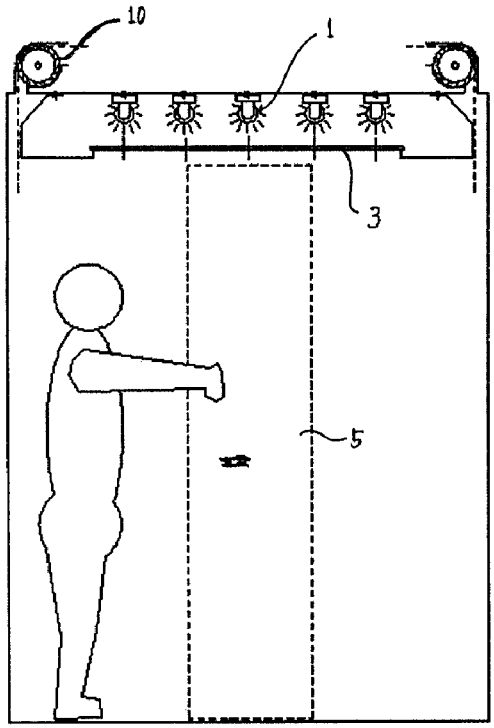
[Fig. 2]
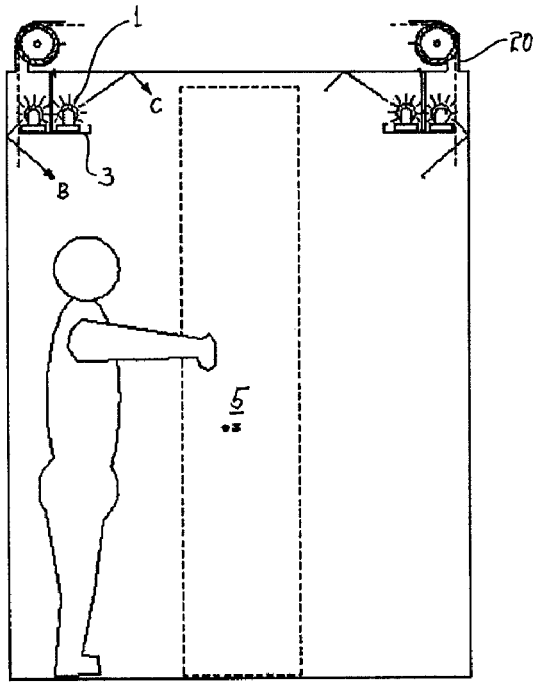

[Fig. 3]
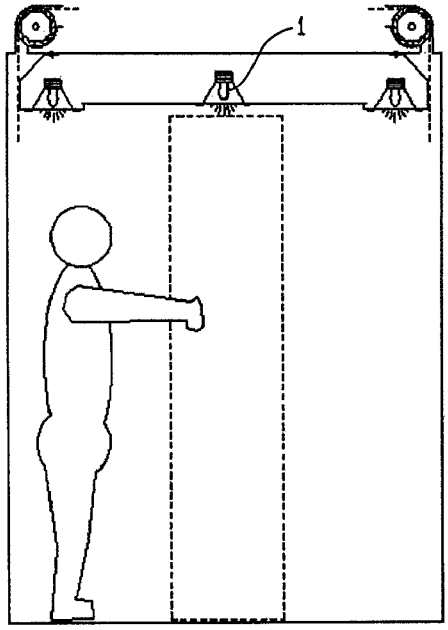
[Fig. 4]
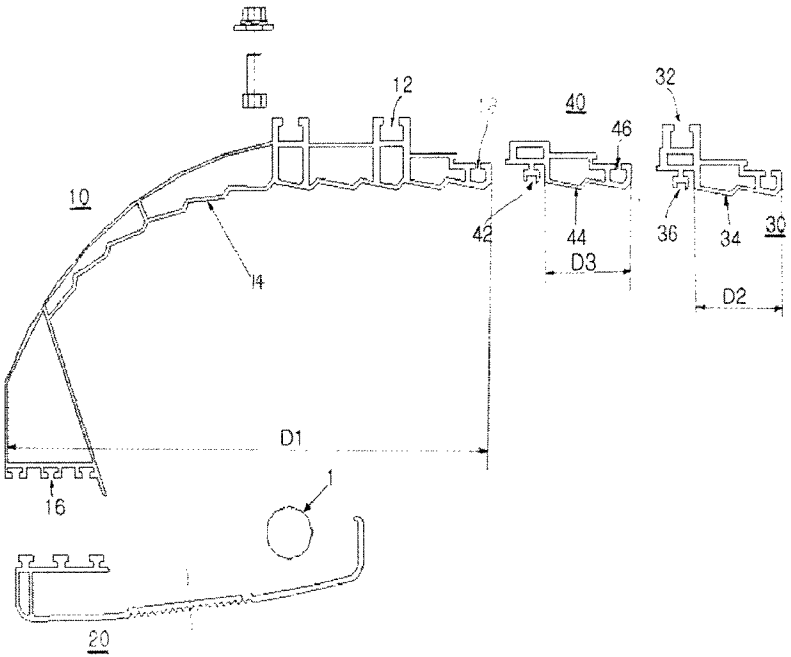

[Fig. 5]
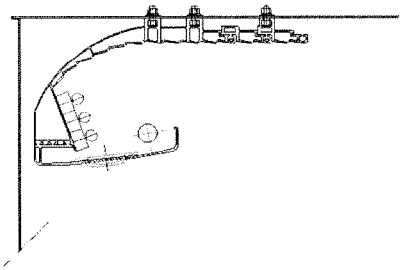
[Fig. 6]
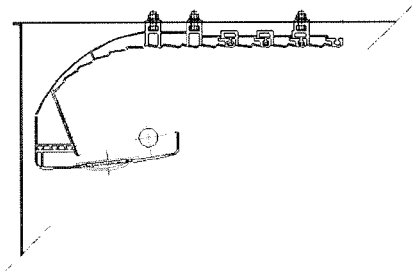
[Fig. 7]
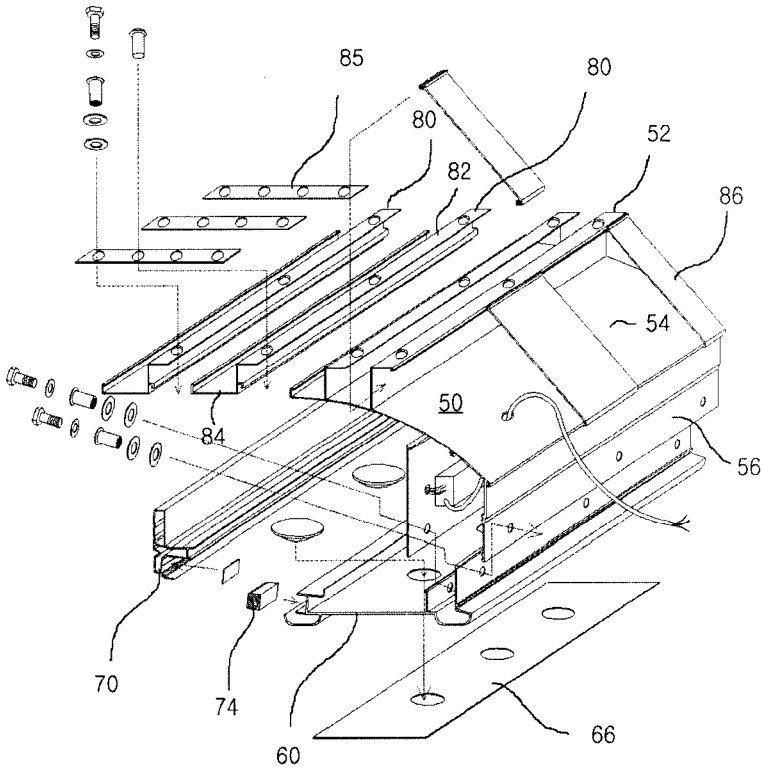

[Fig. 8]
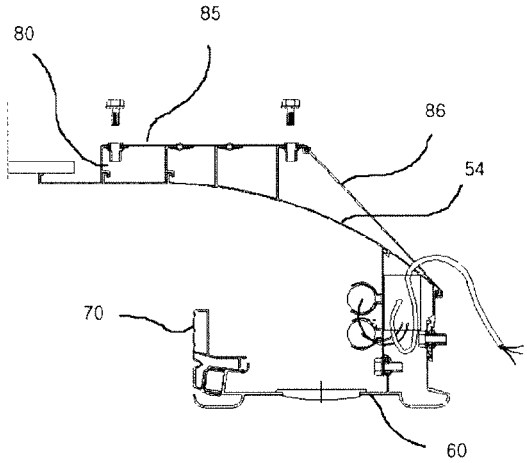
[Fig. 9]
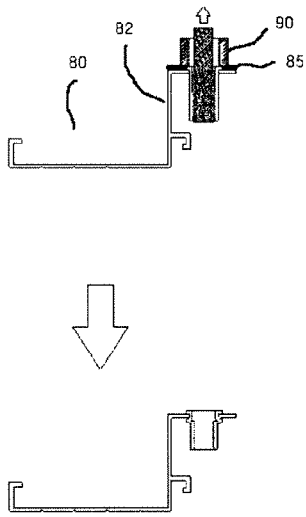
[Fig. 10]
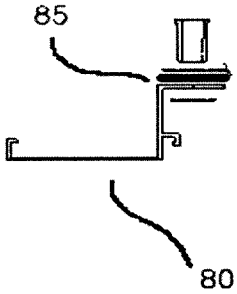

PREFABRICATED LIGHT REFLECTING SYSTEM MOUNTED TO CEILING OF ELEVATOR CAGE

TECHNICAL FIELD

The present invention relates to a prefabricated light reflecting system configured to be mounted to the ceiling of an elevator cage, and, more particularly, to a pre-fabricated light reflecting system in which reflectors, to be mounted at corners of the ceiling of an elevator cage, are prefabricated into standardized products having a pre-determined width, thereby allowing a required number of the reflectors to be successively mounted to correspond to the size of the elevator cage.

BACKGROUND ART

Generally, lighting patterns for use in the interior of an elevator cage are classified into direct lighting patterns, indirect lighting patterns, and mixed direct-indirect lighting patterns.

Referring to FIG. 1, an example of indirect lighting patterns is illustrated. Considering the exemplified indirect lighting pattern, light bulbs 1, such as fluorescent lamps or incandescent lamps, are mounted to the ceiling of an elevator cage, and a translucent shield panel 3 is mounted underneath the light bulbs 1. Since most modern elevators are designed such that blowers 10 are located on corners of an elevator cage and air ducts 20 are arranged at a lower side of the blowers 10, airflow is guided at lateral sides of the light bulbs 1 to thereby be introduced into the elevator cage as shown in FIG. 1.

In the above-described indirect lighting pattern, although the shield panel 3 prevents passenger's eyes from being temporarily blinded with intense light from the light bulbs 1 and ensures effective ventilation in the interior of the elevator cage, the shield panel 3 is easily covered with dust, thereby requiring periodical separation and cleaning thereof. The shield panel 3 is also troublesome in use because it must be separated in the case of exchanging the light bulbs 1. Furthermore, since the shield panel 3 must be mounted throughout the ceiling of the elevator cage, it causes the height of the ceiling to be lowered, making it impossible to transport freight 5, such as a tall wardrobe.

FIG. 2 illustrates another example of indirect lighting patterns. As shown in FIG. 2, the light bulbs 1 are mounted on opaque shield panels 3 so that light emitted from the light bulbs 1 is reflected from the ceiling and wall surface of an elevator cage in directions designated by arrows B and C, rather than being directly illuminated to passengers. In this case, although there is no risk of causing passenger's eyes to be temporarily blinded with intense light from the light bulbs 1 and of lowering the height of the ceiling of the elevator cage, the shield panels 3 tend to partially block paths of airflow, resulting in a poor ventilation of the elevator cage. Further, lighting the interior of the elevator cage using only the light reflected from the ceiling and wall surface of the elevator cage is insufficient to achieve a required luminance, resulting in a low lighting efficiency.

FIG. 3 illustrates an example of direct lighting patterns. As shown in FIG. 3, the light bulbs 1 are mounted to the ceiling of an elevator cage without using a shield panel that intercepts light from the light bulbs 1. With this direct lighting pattern, light from the light bulbs 1 is directly illuminated to passengers, thereby problematically causing passenger's eyes from being temporarily blinded and lowering the height of the ceiling of the elevator cage. Furthermore, due to the fact that incandescent lamps are mainly used as the light bulbs 1, the interior temperature of the elevator is inevitably raised.

Meanwhile, the sizes of elevator cages differ from one another in accordance with their installation places. Such a difference in the sizes of the elevator cages requires that an appropriate number of light bulbs is prepared to correspond to the size of the corresponding elevator cage, and then, are manually mounted separately one by one to the ceiling or wall surface of the elevator cage by means of fasteners. This is an extremely labor intensive task.

DISCLOSURE OF INVENTION

Technical Problem

Therefore, the present invention has been made in view of the above problems, and it is an object of the present invention to provide a prefabricated light reflecting system including reflectors mounted to the ceiling of an elevator cage for indirect lighting, which can provide a predetermined reflection angle suitable to prevent passenger's eyes from being temporarily blinded with intense light from light bulbs while preventing a deterioration of luminous intensity inside the elevator cage by virtue of high reflectivity of reflective surfaces thereof, and also can eliminate the use of a shield panel, thereby preventing accumulation of dust on the light bulbs to thereby keep the interior of the elevator cage in a clean state and eliminating the risk of lowering the height of the ceiling to thereby achieve an improved space utility of the elevator cage.

It is another object of the present invention to provide a prefabricated light reflecting system in which reflective panels are prefabricated into standardized products to facilitate assembling/disassembling thereof, thereby enabling mass production and considerably simplified installation of the light reflecting system.

Technical Solution

In accordance with an aspect of the present invention, the above and other objects can be accomplished by the provision of a prefabricated light reflecting system mounted to the ceiling of an elevator cage comprising: a corner reflector mounted below each air vent formed at a corner of the ceiling while being spaced apart from a wall surface of the elevator cage by a distance of approximately 20 mm, the corner reflector having one or more elongated fastener fitting channels for use in the insertion of fasteners, such as screws, to be fastened to the ceiling of the elevator cage, a reflective surface located underneath the fastener fitting channels, having wholly an arched cross section and being pleated in an accordion shape suitable to reflect light, one or more coupling grooves formed at a lower end of the reflective surface for the coupling of the bulb mounting plate, and a coupling groove formed at an upper end of the reflective surface for the coupling of another reflector, the overall length of the corner reflector being slightly shorter than an inner length of the elevator cage; and a bulb mounting plate snap-fitted to the coupling grooves formed at the lower end of the reflective surface, i.e. a lower end of the corner reflector, the bulb mounting plate serving to prevent light from a light bulb mounted thereon from being directly illuminated to the interior of the elevator cage, wherein the reflector has standard dimensions, and thus can be produced in large quantities via extruding or drawing, and the reflective surface of the reflector is subjected to a surface treatment, such as anodizing.

In accordance with another aspect of the present invention, there is provided a pre-fabricated light reflecting system comprising: a corner reflector mounted below each air vent formed at a corner of the ceiling while being spaced apart from a wall surface of an elevator cage, the corner reflector having one or more elongated coupling plates equidistantly arranged at a top portion of the corner reflector to be coupled to mounts by means of fasteners, an arched reflective plate suspended to the coupling plates, and a side plate vertically connected to an end of the reflective plate, the overall length of the corner reflector being slightly shorter than that of the elevator cage; a bulb shield plate horizontally connected to the side plate by means of fasteners, such as bolts and screws, and adapted to prevent light of a bulb from being directly illuminated to the interior of the elevator cage; an elongated front cover plate vertically connected to an end of the bulb shield plate to hide the bulb, mounted underneath the corner reflector, from view; one or more additional reflectors configured to be connected to each other or be connected to the corner reflector, the additional reflector having a coupling plate to be coupled to the mounts by means of fasteners, and a reflective plate horizontally formed at a lower end of the coupling plate and having a predetermined width; and the mounts used to fasten the coupling plates of the reflectors using fasteners, wherein all the elements are coupled to form a single module to thereby be mounted to the ceiling of the elevator cage.

ADVANTAGEOUS EFFECTS

A light reflecting system according to the present invention has the following effects.

Firstly, since respective reflectors of the system have standard dimensions and modular structure and can be produced in large quantities via extruding or drawing, the manufacturing costs of the reflectors can be considerably reduced, and the reflectors can be easily coupled to one another via snap fitting. This consequently ensures a convenient installation of the light reflecting system.

Secondly, since a reflective surface of the system faces downward, there is no risk of covering the reflective surface with dust. This has the effect of maintaining high reflectivity and simplifying the cleaning of the light reflecting system.

Thirdly, according to the present invention, the number of intermediate reflectors is appropriately adjustable. As a result, the size of the light reflecting system can be adapted to correspond to dimensions of all kinds of elevators.

Fourthly, in the case of the light reflecting system according to another embodiment of the present invention, since the respective reflectors can be made of a single thin plate, the manufacturing costs of the reflectors can be considerably reduced and also the coupling of reflectors can be simplified as compared to the prior art.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a side view illustrating an example of indirect lighting patterns for use in an elevator cage;

FIG. 2 is a side view illustrating another example of indirect lighting patterns;

FIG. 3 is a side view illustrating an example of direct lighting patterns for use in an elevator cage;

FIG. 4 is an exploded sectional view illustrating a light reflecting system in accordance with a first embodiment of the present invention;

FIG. 5 is a partial sectional view illustrating an assembled state of the light reflecting system in accordance with the first embodiment of the present invention;

FIG. 6 is a partial sectional view illustrating a different assembled state of the light reflecting system in accordance with the first embodiment of the present invention;

FIG. 7 is an exploded perspective view illustrating a light reflecting system in accordance with a second embodiment of the present invention;

FIG. 8 is a side sectional view illustrating an assembled state of the light reflecting system of FIG. 7; and FIGS. 9 and 10 are schematic diagrams illustrating an assembling procedure of a reflector of FIGS. 7 and 8.

BEST MODE FOR CARRYING OUT THE INVENTION

Now, preferred embodiments of the present invention will be described in detail with reference to the accompanying drawings.

Although the size of an elevator cage is variable depending on an installation place thereof, all standard passenger elevators are commonly sized so that the width of front wall surfaces at opposite sides of an elevator door is more than 300 mm. Normally, the width is selected from among 300 mm, 350 mm, 400 mm and 450 mm. The present invention is achieved in consideration of these standard sizes. In the following description, the term 'length' refers to the distance from an elevator door to a rear wall of an elevator cage, and the term 'width' refers to the distance between opposite side walls of the elevator cage.

FIG. 4 is an exploded sectional view illustrating a light reflecting system in accordance with a first embodiment of the present invention. It should be understood that a plurality of light reflecting systems is symmetrically mounted at opposite sides of an elevator cage, but only one light reflecting system is shown for the convenience of explanation.

As shown in FIG. 4, the light reflecting system in accordance with the first embodiment of the present invention basically includes a corner reflector 10 configured to be affixed to a corner of the ceiling of an elevator cage, a bulb mounting plate 20, and an end reflector 30. As occasion demands, one or more intermediate reflectors 40 may be added.

The corner reflector 10 is mounted below each air vent formed at a corner of the ceiling while being spaced apart from a wall surface of the elevator cage by a distance of approximately 20 mm. The corner reflector 10 has one or more elongated fastener fitting channels 12 for use in the insertion of fasteners, such as screws, to be fastened to the ceiling of the elevator cage, and a reflective surface 14 located underneath the fastener fitting channels 12. The reflective surface 14 for reflecting light wholly has an arched cross section, and is pleated in an accordion shape. The corner reflector 10 further has lower coupling grooves 16 formed at a lower end of the reflective surface 14 for the coupling of the bulb mounting plate 20, and an upper coupling groove 18 formed at an upper end of the reflective surface 14 for the coupling of the end reflector 30. In due consideration of being mounted inside the cage, the overall length of the corner reflector 10 is determined to be slightly shorter than that of the elevator cage, and the width of the corner reflector 10 has a predetermined standard value. The length and width of the corner reflector 10 will be described hereinafter.

The corner reflector 10 is mounted to the ceiling while being spaced apart from the wall surface by the distance of approximately 20 mm for the ventilation of the interior of the elevator cage. The fastener fitting channels 12 take the form of rails extending throughout the length of the elevator cage. Once fasteners, such as bolts, are inserted into the fitting channels 12, heads of the bolts are captured by the channels 12 to freely move longitudinally without risk of separation. A plurality of the bolts, inserted into the respective fitting channels 12, are also fastened to convenient positions of the ceiling. In this way, the corner reflector 10 is mounted to the ceiling. Although it is general to provide the corner reflector 10 with one or two fitting channels 12, the number of the fitting channels 12 is variable to maximize the convenience of installation. Preferably, the reflective surface 14 wholly has an arched cross section, and is pleated to be similar to an accordion. Such an accordion shape is effective to obtain a desired light reflection angle.

The bulb mounting plate 20 is snap-fitted to the coupling grooves 16 formed at the lower end of the reflective surface 14, i.e. a lower end of the corner reflector 10. The bulb mounting plate 20 serves to mount a light bulb 1 thereon to prevent direct lighting of the bulb 1, and has an approximately rectangular shape. Preferably, the bulb mounting plate 20 is coupled to the corner reflector 10 in a snap-fitting manner as male bosses thereof are snap-fitted into female recesses of the reflector 10. In consideration of the case that bulbs having a low brightness are used, if necessary, the mounting plate 20 may be perforated with light passage holes.

The end reflector 30 is configured to be coupled to the corner reflector 10 or intermediate reflector 40 that will be described hereinafter. The end reflector 30 has an elongated fastener fitting channel 32, and a reflective surface 34 located underneath the fastener fitting channel 32. Similarly, the reflective surface 34 is pleated to have an accordion shape, thereby being successively connected to the reflective surface 14 of the corner reflector 10. The end reflector 30 further has a coupling protrusion 36 to be snap-fitted into the coupling groove 18 formed at the upper end of the corner reflector 10. The length of the end reflector 30 is the same as that of the corner reflector 10, and the width of the end reflector 30 has a predetermined standard value. In the case of the end reflector 30, the configuration of the fitting channel 32 and the reflective surface 34 is identical to that of the corner reflector 10.

The reflectors 10 and 30 have standard dimensions, and thus can be produced in large quantities via extruding or drawing. Preferably, the reflective surfaces 14 and 34 of the reflectors 10 and 30 are subjected to a certain surface treatment, such as anodizing, to increase reflectivity.

The intermediate reflector 40 is used to increase the total area of the reflective surface of the light reflecting system, and is interposed between the two reflectors 10 and 30. Similar to the reflectors 10 and 30, the intermediate reflector 40 has a coupling protrusion 42 to be coupled to the coupling groove 18 of the corner reflector 10, a reflective surface 44 having a pleated accordion shape to be successively connected with the reflective surfaces 14 and 34, and a coupling groove 46 to be snap-fitted with the coupling protrusion 36 of the end reflector 30. The length of the intermediate reflector 40 is the same as that of the other reflectors 10 and 30, and the width of the reflector 40 has a predetermined standard value. Preferably, the coupling protrusion 42 and the coupling groove 46 of the intermediate reflector 40 are configured to be mated with corresponding coupling groove and protrusion of the other reflectors in a female-male coupling manner. According to the size of the elevator cage, one or more intermediate reflectors may be successively connected to each other.

Now, the dimensions of the reflectors 10, 30 and 40 will be explained.

As shown in FIG. 4, preferably, a width D1 of the corner reflector 10 is approximately 280 mm. This value is determined in consideration of the fact that a width of most elevators, between the edge of an elevator door and the side wall of the elevator cage, is approximately 300 mm. For the ventilation of the interior of the elevator cage, it is preferable to space an end of the corner reflector 10 apart from the side wall by the distance of approximately 20 mm.

Preferably, a width D2 of part of the end reflector 30, which is exposed to the outside after the end reflector 30 is coupled to the corner or intermediate reflector, is approximately 50 mm, and a width D3 of the intermediate reflector, which is exposed to the outside after the intermediate reflector is coupled to the corner reflector, is approximately 50 mm. Standardizing dimensions of all the reflectors facilitates mass production and installation thereof.

FIG. 5 is a sectional view illustrating a state wherein only the end reflector 30 is coupled to the corner reflector 10. FIG. 6 is a sectional view illustrating a state wherein a single intermediate reflector 40 is inserted between the reflectors 10 and 30. By inserting an appropriate number of intermediate reflectors to correspond to the size of an elevator cage, it is possible to adapt a lighting reflecting system for the elevator cage.

FIG. 7 is an exploded perspective view illustrating a light reflecting system in accordance with a second embodiment of the present invention. FIG. 8 is a side sectional view illustrating an assembled state of the light reflecting system.

As shown in FIGS. 7 and 8, the light reflecting system of the present embodiment includes a corner reflector 50 to be mounted to a corner of the ceiling of an elevator cage, a bulb shield plate 60, a front cover plate 70, one or more additional reflectors 80, and a plurality of mounts 85.

The corner reflector 50 is mounted below each air vent formed at a corner of the ceiling while being spaced apart from a wall surface of the elevator cage. The corner reflector 50 has one or more elongated coupling plates 52 equidistantly arranged at a top portion of the corner reflector 50 to be coupled to the mounts 85 by means of fasteners, such as screws, bolts, and insert nuts, an arched reflective plate 54 suspended to the coupling plates 52, and a side plate 56 vertically connected to an end of the reflective plate 54. Preferably, in due consideration of being mounted inside the cage, the overall length of the corner reflector 50 is determined to be slightly shorter than that of the elevator cage and the width of the corner reflector 50 has a predetermined standard value.

The corner reflector 50 is mounted to the ceiling while being spaced apart from the wall surface of the elevator by a distance of 20 mm for the ventilation of the elevator interior. Generally, one or two coupling plates 52 extend upward from an upper surface of the reflective plate 54 and are arranged by an appropriate distance. The coupling plates 52 are thin metal or plastic plates having the same length as that of the reflective plate 54. Upper ends of the coupling plates 52 are bent by a right angle to provide a fastener coupling portion. The coupling between the coupling plates 52 and 82 will be explained hereinafter.

The bulb shield plate 60 is a flat thin rectangular plate to be coupled to a lower end of the side plate 56 of the reflector 50 by means of fasteners, such as bolts, and screws. A light bulb is mounted between the reflective plate 54 and the bulb shield plate 60. The bulb shield plate 60 serves to prevent light of the bulb from being directly illuminated to passengers inside the elevator cage. In consideration of the case that bulbs having a low brightness are used, if necessary, the bulb shield plate 60 may be perforated with light passage holes.

The front cover plate 70 is vertically connected to an end of the bulb shield plate 60, and serves to hide the bulb from view. Preferably, the front cover plate 70 is mounted in an easily separable manner for the replacement or repair of the bulb. Therefore, it is more preferable to attach the front cover plate 70 to the bulb shield plate 60 by means of magnets 74, instead of screws, and bolts. That is, a plurality of magnets 74 is equidistantly arranged by an appropriate distance along the overall length of a front end of the bulb shield plate 60. When the front cover plate 70 is made of a non-magnetic material, such as plastic, certain magnetically attractable members, such as iron plates, that correspond to the respective magnets 74, are appropriately arranged to detachably couple the front cover plate 70 to the bulb shield plate 60. Use of the magnets is effective to enable easy manual separation of the front cover plate for the replacement or repair thereof.

Meanwhile, it may be necessary to connect one or more additional reflectors 80 to the corner reflector 50 depending on the size of an elevator cage. For easy connection of the reflectors 80, according to the present invention, each reflector 80 has an L-shaped cross section.

The reflector 80 has a coupling plate 82 to be coupled to the mounts 85 by means of fasteners, and a horizontal reflective plate 84 having a predetermined width. The reflective plate 84 extends laterally from a lower end of the coupling plate 82. As can be seen from the drawing, for the convenience of assembling and disassembling, it is preferable that the reflector 80 be snap fitted to the corner reflector 50 in a female-male coupling manner. Admittedly, a plurality of the reflectors 80 may be coupled to one another via the same snap fitting.

The above-described two kinds of reflectors 50 and 80 are assembled to a plurality of the mounts 85, which are equidistantly arranged by a constant distance. As shown in FIG. 7, the coupling plates 52 and 82 of the reflectors 50 and 80 are fastened to the plurality of mounts 85 by means of fasteners. With such a coupling manner, all of the above-described parts 50, 60, 70, 80 and 85 are assembled to one another, thereby completing a single module. By attaching the resulting module to the ceiling of an elevator, the installation of the light reflecting system is completed.

Now, the coupling manner between the additional reflectors 80 and the mounts 85 will be explained with reference to FIGS. 9 and 10.

In the first embodiment of the present invention as shown in FIG. 4, the rail-type fastener fitting channels 12 are coupled to the heads of bolts fastened to the ceiling of the elevator cage. However, the rail-type fitting channels have a complex structure, resulting in an increase of manufacturing and labor costs and a troublesome workability. Therefore, for the convenience of work and the saving of manufacturing costs, the coupling plate 82 of the present invention has an L-shaped form obtained by bending a thin plate. This configuration is effective to facilitate the manufacture of the coupling plate 82 while saving manufacturing costs thereof. Here, although the coupling plate 82 can be coupled to the mount 85 by means of screws or bolts, it is preferable to use insert nuts 90 for the convenience of work.

As shown in FIGS. 9 and 10, the insert nut 90, as well known in the art, takes the form of a combination of a rivet and nut. In a state wherein washers are arranged at opposite sides of the coupling plate and the mount, a bolt fitted in the nut is tightened to enable a rivet coupling. Use of the insert nut ensures a considerably convenient coupling operation. Admittedly, the coupling manner using insert nuts is also applicable to the reflector 50. After coupling the coupling plates to the mounts, the resulting light reflecting system has a single assembly form. Thereby, the light reflecting system can be conveniently mounted as the resulting assembly is mounted to the ceiling of an elevator cage. This results in a considerable improvement in workability.

Meanwhile, the reflective plate 54 of the reflector 50 is a thin metal or plastic plate, and may be bent or deformed after the lapse of a long period. To solve this problem, preferably, a plurality of reinforcing bars 86 is mounted at the top portion of the reflective plate 54. The reinforcing bars 86 are connected at opposite ends thereof to lateral ends of the coupling plate 52 and the reflective plate 54, thereby serving to keep original shape of the reflective plate 54.

To improve the interior structure of the elevator cage, also, a decorative sheet 66 may be attached to a lower surface of the bulb shield plate 60.

Admittedly, it is preferable that the above-described reflectors 50 and 80 are standardized. Standardizing the sizes of the reflectors enables mass production thereof. Preferably, a width of the reflector 80 is approximately 50 mm. In this case, by appropriately increasing or reducing the number of reflectors 80 according to the size of the elevator cage, it is possible to obtain a light reflecting system suitable to the elevator cage.

The invention claimed is:

1. A prefabricated light reflecting system mounted to the ceiling of an elevator cage comprising:

a corner reflector mounted below each air vent formed at a corner of the ceiling while being spaced apart from a wall surface of the elevator cage by a distance of approximately 20 mm, the corner reflector having one or more elongated fastener fitting channels for use in the insertion of fasteners, to be fastened to the ceiling of the elevator cage, a reflective surface located underneath the fastener fitting channels, having wholly an arched cross section and being pleated in an accordion shape suitable to reflect light, one or more coupling grooves formed at a lower end of the reflective surface for the coupling of the bulb mounting plate, and a coupling groove formed at an upper end of the reflective surface for the coupling of another reflector, the overall length of the corner reflector being slightly shorter than an inner length of the elevator cage; and a bulb mounting plate snap-fitted to the coupling grooves formed at the lower end of the reflective surface, the bulb mounting plate serving to prevent light from a light bulb mounted thereon from being directly illuminated to the interior of the elevator cage, wherein: the reflector has standard dimensions, and thus can be produced in large quantities via extruding or drawing; and the reflective surface of the reflector is subjected to a surface treatment.

2. The system as set forth in claim 1, further comprising:

an end reflector having an elongated fastener fitting channel for use in the insertion of a fastener to be fastened to the ceiling of the elevator cage, a reflective surface located underneath the fastener fitting channel and being pleated in an accordion shape to be successively connected to the reflective surface of the corner reflector, and a coupling protrusion to be snap-fitted into the coupling groove formed at the upper end of the corner reflector, a length of the end reflector being the same as that of the corner reflector, and a width of the end reflector having a predetermined value.

3. The system as set forth in claim 2, further comprising:

one or more intermediate reflectors mounted between the corner and end reflectors to be coupled to both the reflectors, each intermediate reflector having a coupling protrusion to be coupled to the coupling groove of the corner reflector;

a reflective surface having a pleated accordion shape to be successively connected with the reflective surfaces of the corner and end reflectors; and a coupling groove to be snap-fitted with the coupling protrusion of the end reflector, a length of the intermediate reflector being the same as that of the corner or end reflector, and a width of the reflector having a predetermined value.

4. The system as set forth in any one of claims 1 to 3, wherein the corner, intermediate and end reflectors are coupled to one another via their coupling protrusions and grooves in a female-male coupling manner.

5. The system as set forth in claim 4, wherein:

the width of the corner reflector is approximately 280 mm;

a width of part of the end reflector, which is exposed to the outside after the end reflector is coupled to the corner or intermediate reflector, is approximately 50 mm; and a width of the intermediate reflector, which is exposed to the outside after the intermediate reflector is coupled to the corner reflector, is approximately 50 mm.

6. A prefabricated light reflecting system comprising:

a corner reflector mounted below each air vent formed at a corner of the ceiling while being spaced apart from a wall surface of an elevator cage, the corner reflector having one or more elongated coupling plates equidistantly arranged at a top portion of the corner reflector to be coupled to mounts by means of fasteners, an arched reflective plate suspended to the coupling plates, and a side plate vertically connected to an end of the reflective plate, the overall length of the corner reflector being slightly shorter than that of the elevator cage;

a bulb shield plate horizontally connected to the side plate by means of fasteners and adapted to prevent light of a bulb from being directly illuminated to the interior of the elevator cage;

an elongated front cover plate vertically connected to an end of the bulb shield plate to hide the bulb, mounted underneath the corner reflector, from view;

one or more additional reflectors configured to be connected to each other or be connected to the corner reflector, the additional reflector having a coupling plate to be coupled to the mounts by means of fasteners, and a reflective plate horizontally formed at a lower end of the coupling plate and having a predetermined width; and the plurality of mounts used to fasten the coupling plates of the reflectors using fasteners, wherein all the elements are coupled to form a single module to thereby be mounted to the ceiling of the elevator cage.

7. The system as set forth in claim 6, wherein insert nuts, each taking the form of a rivet and nut assembly, are used to assemble the coupling plates to the mounts.

8. The system as set forth in claim 6 or 7, wherein the front cover plate is detachably coupled to the bulb shield plate by means of magnets.

9. The system as set forth in claim 6 or 7, wherein a plurality of reinforcing bars is mounted at a top portion of the reflective plate of the corner reflector.

10. The system as set forth in claim 6 or 7, wherein a decorative sheet is attached to a lower surface of the bulb shield plate.

11. The system as set forth in claim 6 or 7, wherein a width of part of the additional reflector, which is exposed to the outside after the additional reflector is coupled to the corner reflector, is approximately 50 mm.

* * * * *